US007766795B2

(12) United States Patent
Publicover

(10) Patent No.: US 7,766,795 B2
(45) **Date of Patent: *Aug. 3, 2010**

(54) TRAMPOLINE SYSTEM

(75) Inventor: Mark W. Publicover, Saratoga, CA (US)

(73) Assignee: JumpSport, Inc., Saratoga, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/389,138

(22) Filed: Feb. 19, 2009

(65) Prior Publication Data

US 2009/0156366 A1 Jun. 18, 2009

Related U.S. Application Data

(63) Continuation of application No. 10/639,601, filed on Aug. 11, 2003, now Pat. No. 7,611,443.

(60) Provisional application No. 60/402,338, filed on Aug. 9, 2002, provisional application No. 60/402,429, filed on Aug. 9, 2002.

(51) Int. Cl.
*A63B 5/11* (2006.01)

(52) U.S. Cl. ..... 482/27; 482/28

(58) Field of Classification Search ..... 482/27, 482/28, 29; D21/797, 662, 621
See application file for complete search history.

(56) References Cited

U.S. PATENT DOCUMENTS

| | | | | |
|---|---|---|---|---|
| 3,201,126 | A | 8/1965 | Nissen | |
| 5,399,132 | A | 3/1995 | Bailey | |
| 6,053,845 | A | 4/2000 | Publicover | |
| 6,261,207 | B1 | 7/2001 | Publicover | |
| 6,319,174 | B1 | 11/2001 | Alexander | |
| 6,336,893 | B1 | 1/2002 | Chen | |
| 6,679,811 | B2 | 1/2004 | Chen | |
| D570,947 | S * | 6/2008 | Horne | D21/797 |
| 2006/0194674 | A1 * | 8/2006 | Hickey | 482/27 |
| 2006/0270525 | A1 * | 11/2006 | Colling | 482/27 |
| 2008/0269019 | A1 * | 10/2008 | Lovley, II | 482/27 |
| 2009/0005221 | A1 * | 1/2009 | Alexander | 482/27 |
| 2009/0023558 | A1 * | 1/2009 | VanElverdinghe | 482/29 |

FOREIGN PATENT DOCUMENTS

FR 2623719 11/1987

OTHER PUBLICATIONS

U.S. Appl. No. 60/050,323, filed Jun. 20, 1997, Publicover.
U.S. Appl. No. 60/052,052, filed Jul. 9, 1997, Publicover.
U.S. Appl. No. 60/087,835, filed Jun. 3, 1998, Publicover.

* cited by examiner

*Primary Examiner*—Jerome W. Donnelly
(74) *Attorney, Agent, or Firm*—Klarquist Sparkman, LLP

(57) ABSTRACT

A fence surrounds a trampoline and extends above the rebounding surface, reducing the risk of injury. Shock absorption is aided by a support system of independent poles. Variable placement net fasteners also are detailed.

2 Claims, 8 Drawing Sheets

TRAMPOLINE SYSTEM

CROSS REFERENCE TO RELATED APPLICATIONS

This is a continuation of application Ser. No. 10/639,601, filed Aug. 11, 2003 now U.S. Pat. No. 7,611,443, which claims the benefit of U.S. Provisional Application No. 60/402,338, filed Aug. 9, 2002, and U.S. Provisional Application No. 60/402,429, filed Aug. 9, 2002, all of which prior applications are incorporated herein by reference in their entireties.

BACKGROUND AND SUMMARY

The present invention concerns wall structures used with trampolines to protect trampoline users.

The entire content of the following patent applications and patents is incorporated herein by reference: U.S. Provisional Application No. 60/050,323, filed Jun. 20, 1997; U.S. Provisional Application No. 60/052,052, filed Jul. 9, 1997; U.S. Provisional Application No. 60/087,835, filed Jun. 3, 1998; U.S. application Ser. No. 09/100,586, filed Jun. 19, 1998, now U.S. Pat. No. 6,053,845, issued Apr. 25, 2000; and U.S. application Ser. No. 09/432,998, filed Nov. 2, 1999, now U.S. Pat. No. 6,261,207, issued Jul. 17, 2001.

DETAILED DESCRIPTION

Figure 1:
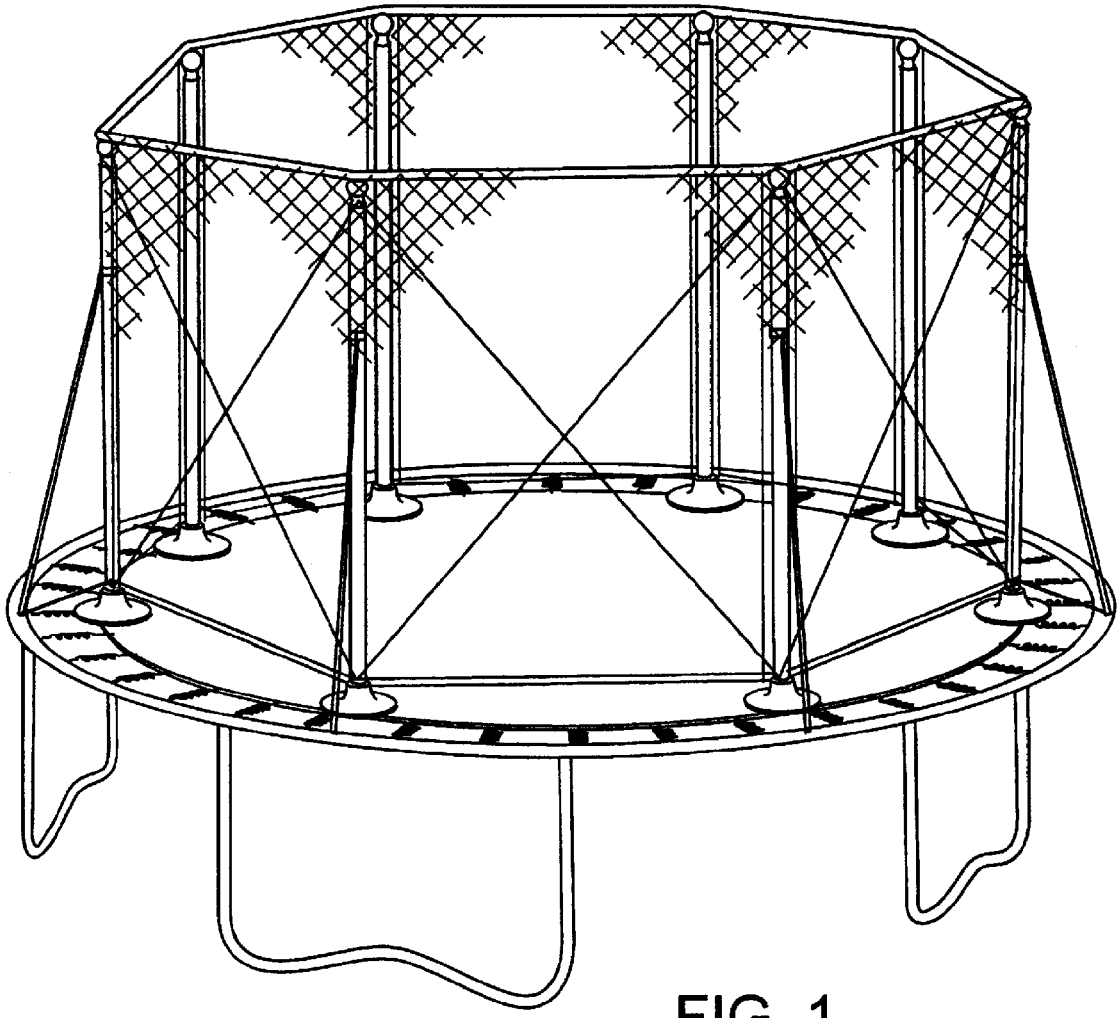
FIG. 1 is an oblique view showing a trampoline apparatus including an enclosure system.
Figure 5:
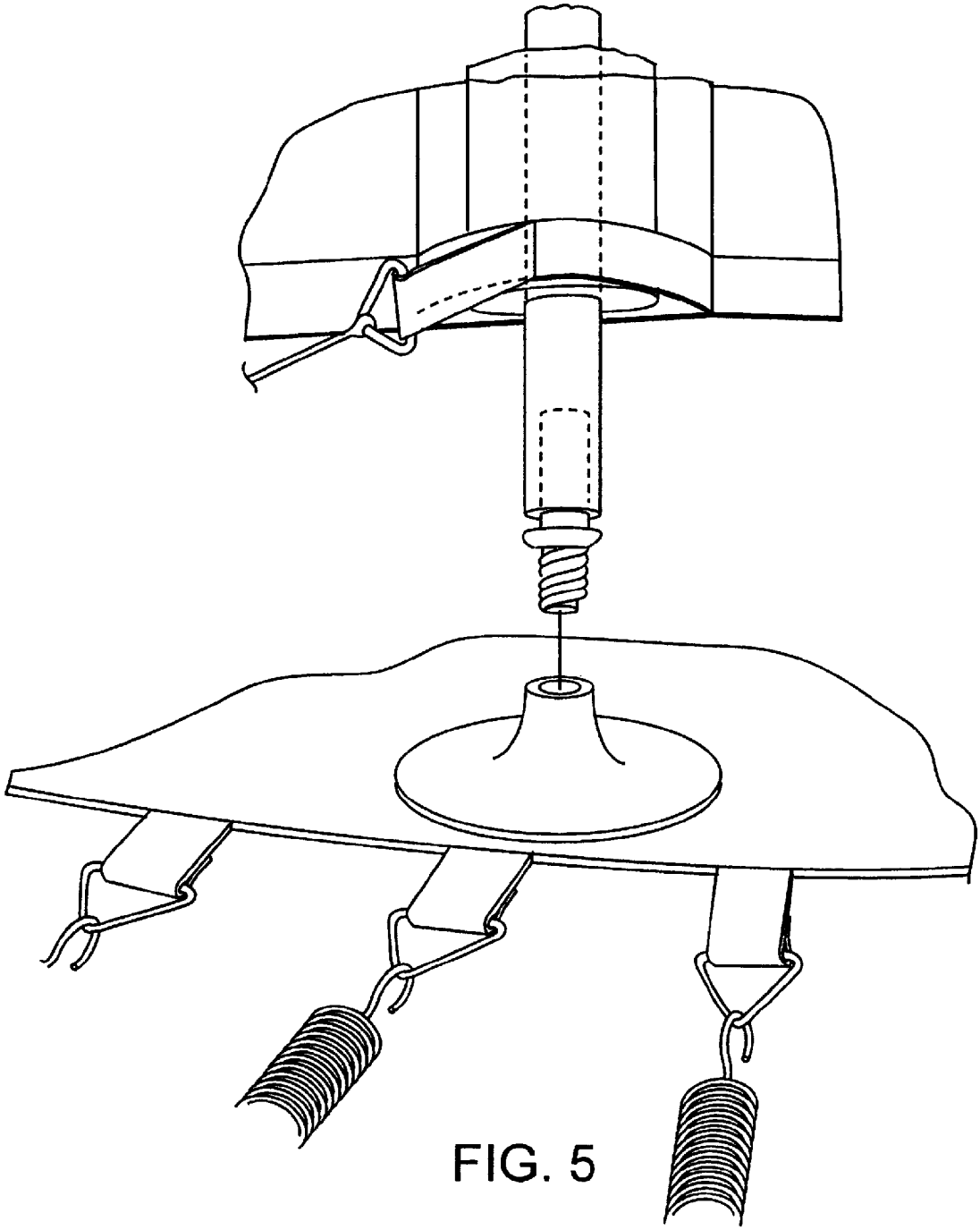
FIG. 5 is an enlarged, exploded partial side view of the apparatus shown in FIG. 1.

Trampolines come in a variety of configurations and sizes. A popular trampoline 20 is shown in FIGS. 1 and 5. The illustrated trampoline has a circular frame 34 supported by multiple U-shaped tubular legs 36. The U-shaped legs have two vertically extending sections 37 connected by a horizontal section that rests on the ground. The upper ends of the vertical leg sections 37 are secured to the frame by welds or other forms of attachment. For ease in storage, it is convenient for the legs to be removable. This is made possible by providing a swage joint in each vertical leg section 37. (In some systems, the legs 36 are not removable but are fixedly secured to the frame. In such systems, it is sometimes desirable to secure the legs to the ground, as by coupling to screw-in ground anchors. The coupling can be inelastic or elastic.)

In a preferred system, at least the top of frame is covered with a pad 38 that is made of or contains a resilient foam material to help cushion any impact against the frame.

A plurality of spring members 39 tautly attach a sheet of sturdy fabric to the frame so that the fabric provides a bed or mat 41, the top of which acts as rebounding surface 40.

Other types of trampolines, having variations in structure such as individual legs secured by bolts or the like, will equally benefit from the present system.

The illustrated trampoline is augmented by a safety enclosure system 30 that provides a protective and interactive environment for a trampoline user. In the illustrated system, plural poles 44 extend vertically with at least the lower half of each pole extending upwardly at more than a 60 degree angle from horizontal. The illustrated system 30 includes poles 44 that are located above the mat 41 and that extend only above the mat, with each pole extending upwardly at an angle of about 90 degrees to the surface of the mat, which extends substantially horizontally. At least some of the poles are supported by base plates 46 that in turn are supported by the surface 40 of the rebounding mat 41. In the illustrated system, all the poles 44 are supported by base plates 46 and are located inwardly of the perimeter of the rebounding mat 41 and inwardly of the perimeter of the trampoline frame.

In the illustrated system, each pole 44 has a plug 48 that is received in a socket 50 defined in one of the base plates 46. The illustrated plug and socket have mating threads, but unthreaded plugs and sockets also can be used.

The base plates 46 conveniently may be made of molded rubber or plastic, but also can be made of other materials. For example, a base plate might be made of fabric having an upwardly opening pocket formed to receive the bottom of a pole 44 or a plug 48 at the bottom of a pole. The material and construction should be selected to minimize abrasion between the base plate and the surface 40.

The illustrated base plates 46 are not fixedly attached to the rebounding surface 40. One or more straps (not shown) may be provided to connect the base plate to the frame so that the base plate is held in a desired location and cannot move more than a predetermined distance toward the center of the rebounding surface 40. A single strap might extend inwardly to a pole from one location on the frame and then back from the pole to another location on the frame so that the strap forms a generally V-shape. A portion of such a strap could extend around the base plate or supported pole, or could extend through an opening, ring or loop provided on the base plate. In some instances, a base plate could be affixed to the surface 40, in which instances a strap would not be required.

Each pole 44 may be covered or partially covered with a layer of padding 84 made from a resilient foam material, with or without a fabric cover. The illustrated padding 84 is a rectangular strip of ¼" inch foam that extends along the pole 44 and that faces the interior of the chamber. Alternatively, the padding may be a rectangular sheet wrapped entirely the pole 44 and secured by fasteners or a surrounding sleeve. Or the padding may be tubular so that there is no seam. A variety of weather-resistant foam materials can be used. Such foam material serves as cushioning for a person who impacts one of the poles 44.

In the illustrated system, an end cap 86 is provided as an upper extension of each pole 44. The end cap has a rounded upper portion 88 and a centrally located neck portion 90, both of which are concentric to the axis A of the pole 44. The illustrated cap 86 is made of rubber or a shatter-resistant plastic material.

A generally cylindrical wall 100 of a flexible material is suspended between the poles 44 to define a chamber above the rebounding surface. The illustrated chamber is open at the top as shown in FIG. 1 (although in other systems this may not be the case). The wall 100 has top and bottom edges 101, 102 and is made of a lightweight plastic sheet material. Particularly suitable is the polypropylene fabric that is commonly used for trampoline beds. This fabric and the other nonmetal elements described herein are best made of materials that are both abrasion-resistant and are resistant to weathering, e.g. by exposure to UV light. Suitable materials generally are made of polypropylene, nylon, high-density polyethylene, or Dacron polyester.

Preferably a hem or other finishing reinforces the top and bottom edges 101, 102. Generally, the wall material will be a rectangular piece having a width that is the same as the height of the wall, and a length that is somewhat longer than the circumference of the enclosure.

A support system is provided to hold the wall 100 in place. At the top, a flexible line 108 extends pole-to-pole near the top of the chamber. A reach of the line 108 couples each pair of adjacent poles 44. In the illustrated system, the line 108 although flexible, is generally inelastic. The line 108 thus allows the tops of the poles to move relative to one another, but the tops of two adjacent poles can not move away from each other to any great extent. The line 108 is made of a sturdy, weather-resistant material such as 1" nylon webbing. Nylon webbing has little elasticity and thus will not sag after it is installed. Webbing is better than rope for line 108 since rope has a relatively low surface area and thus would tend to cut into and abrade the body of a person who bounced into contact with the line 108. Webbing has a relatively high surface area and automatically rotates so that a flat face of the webbing contacts any impacting body. The flat webbing face distributes resistive force over a greater portion of a person's body and is relatively nonabrasive. The illustrated top line 108 is a single continuous piece that is sewn to the wall 100 along the top edge 101.

The wall 100 is secured to the upper line 108 along portions thereof extending between the poles 44. This can be accomplished in a variety of ways. For example, the top line 108 can be sewn to the wall 100 along the top edge 101. Or the line 108 could extend through a series of horizontally extending sleeves formed along the top edge 101 of the wall.

A similar arrangement can be used to secure the bottom edge 102 of the wall 100 at the periphery of the rebounding surface. For example, a strap of one-inch polypropylene webbing can extend pole-to-pole at an elevation near that of the frame. A reach of the webbing thus extends between each pair of adjacent poles 44.

The webbing additionally can be secured to the frame 34 at intervals between the poles 44, by cable ties (not shown) or other fasteners. Also a strip of hook and loop fastening tape, such as VELCRO® tape, can be secured along the bottom edge 102 of the wall 100 and a mating strip of the hook and loop fastening system can be secured to the frame, or to the pad 38 that covers the frame, or to the rebounding surface 40, so bottom of the wall 100 can be secured by mating both strips of the hook and loop fastening tape system. And other arrangements can be used to secure the bottom edge 102.

By arrangements such as the foregoing, the fence is constrained in size so as not to encompass any part of the frame within chamber. Desirably, the fence does not extend much—if any—beyond the rebounding surface itself. In some such systems, the annular pad 38 can be omitted except in a gangway region, since the fence will prevent user impacts against the springs 39.

Desirably, wall 100 is secured to each pole 44 along its vertical length by an arrangement that includes a length of fabric sewn to the wall 100 to form a vertically extending sleeve or tubular pocket 128 that snugly receives a pole 44 and the padding material 84.

Figure 2:
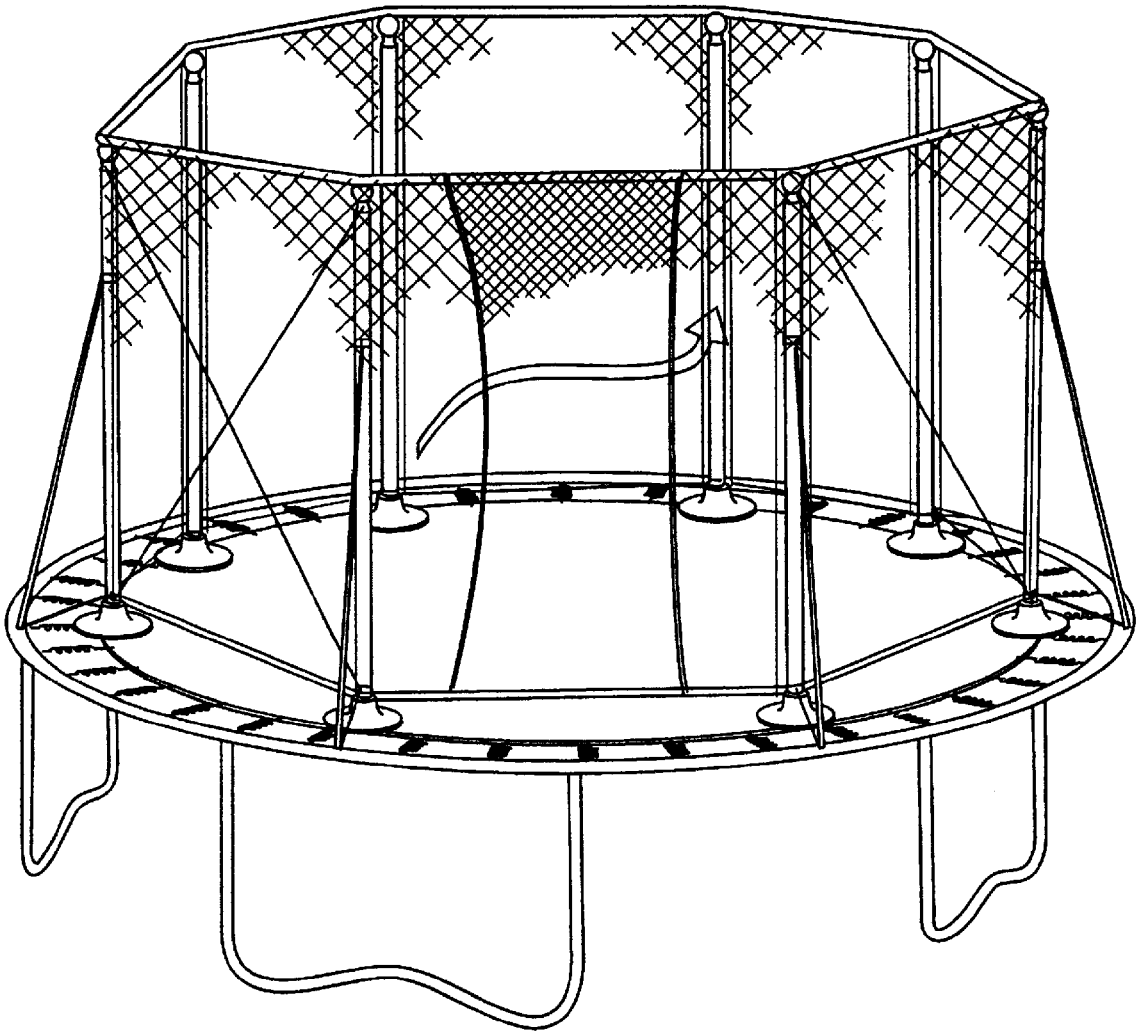
FIG. 2 is an enlarged partial oblique view of a wall portion of the apparatus shown in FIG. 1.
Figure 3:
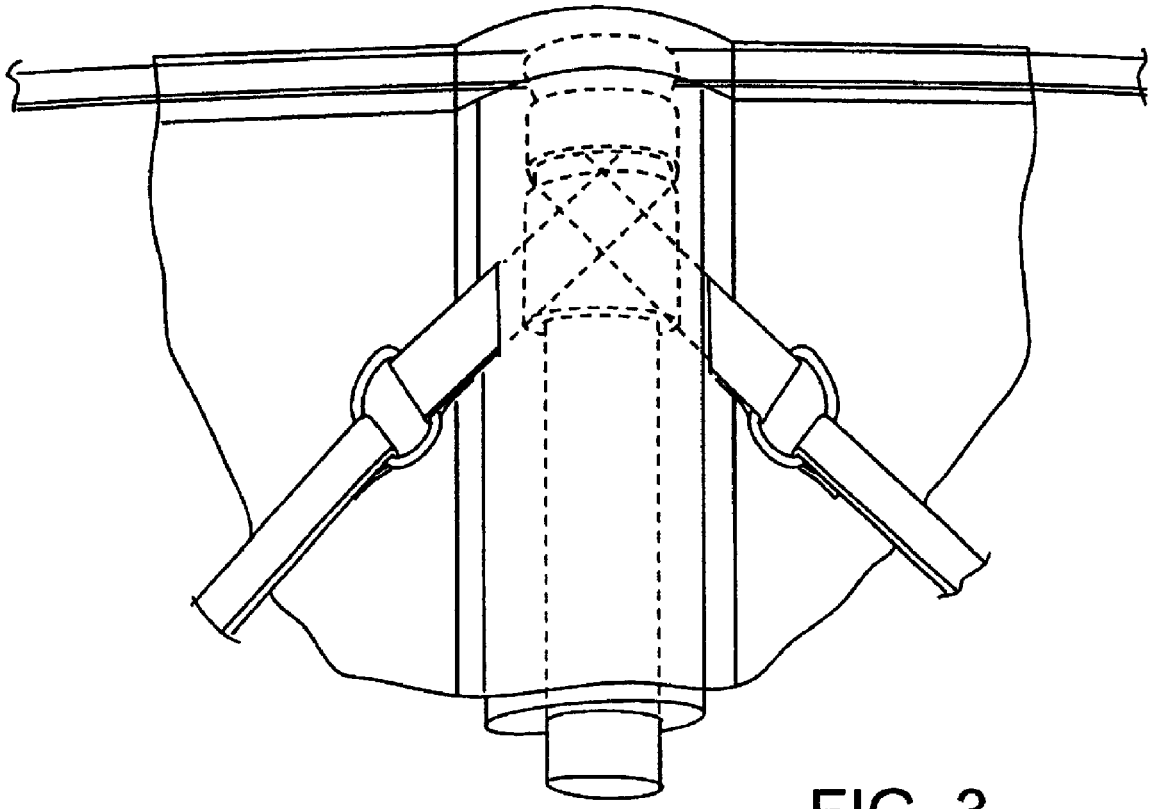
FIG. 3 is an enlarged partial side view of the apparatus shown in FIG. 1.
Figure 4:
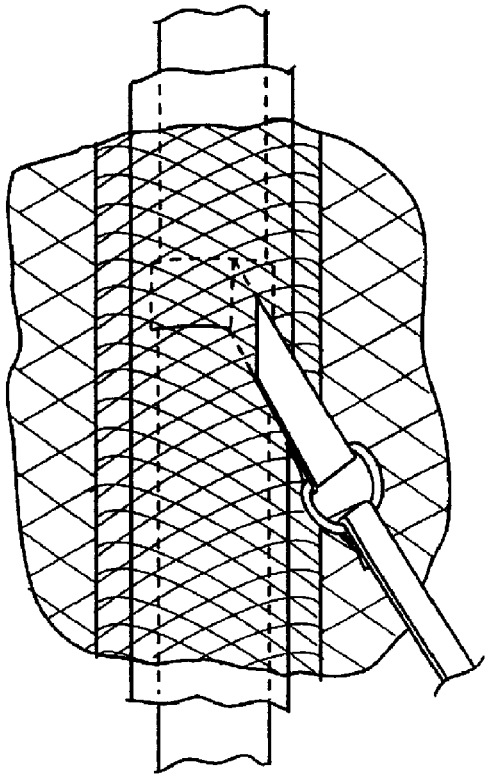
FIG. 4 is an enlarged partial side view of the apparatus shown in FIG. 1.

Because the wall material 100 is longer than the circumference of the enclosure, ends portions of the wall fabric overlap as shown in FIG. 2 to provide a passageway to permit access to the chamber. Desirably, the overlapping portions are secured so as to prevent a jumper from falling off of the trampoline through the passageway.

If desired, a locking device, such as padlock, can be used to hold the overlapping end portions together, thereby impeding access to the trampoline surface.

The illustrated enclosure system has walls that are strong but highly resilient. When a person jumps from the trampoline surface 40 and hits the wall 100 of the enclosure, the wall moves a short distance in the direction of the force applied by the user and thereby absorbs energy and cushions the shock. The tops of all the poles 44 in the illustrated system—because they are linked together at the top by the top line 108—flex toward the impacted portion of the wall panel.

In systems in which the bottom of the netting is attached to the periphery of the flexible rebounding surface 40, the system can be conceptualized as an arrangement of upright long tubular springs attached to a diaphragm that helps disperse, absorb, and re-cycle impact forces directed at the poles and the net. The diaphragm also transfers these forces to the support system that maintains the diaphragm's elevation. In order to provide the above-described spring effect, the poles 44 should not be rigid. The poles should be sufficiently strong that impacts by trampoline users will not permanently bend the poles. But, the poles 44 should be able to flex to some extent when a trampoline user impacts the wall 100.

For ease of construction and low cost, the illustrated poles 44 are made of PVC, for example, one-inch Schedule 40 PVC pipe. Other materials, such as ½ inch tubular steel, plastic, fiberglass, graphite, carbon fiber, Kevlar, etc., can be used if they have appropriate strength and flexibility characteristics. The particular material(s) can be selected to tailor the flexibility, elasticity, and strength of the resultant system as desired.

As most clearly seen in FIG. 1, cross-bracing straps 144 are provided to limit the movement of adjacent poles 44 toward or away from one another. A preferred cross-bracing material is substantially inelastic nylon webbing; plastic or metal cable could also be used. The cross-bracing extends, in pairs of crossing reaches, from positions near the upper end portions of two adjacent poles 44 to positions that are near the elevation of the frame, so that an X-shaped pair of straps extend between each pair of adjacent poles 44.

In the illustrated system, V-rings 150 are provided at the base of each sleeve 128 and are held by fabric loops 152. The v-rings serve as attachments for the bottom ends of the cross-bracing straps and/or a bottom strap that extends along the edge 102. Or a second ring (not shown) may be held by each cloth loop at the bottom, so that one ring attaches to the cross-bracing strap 144 and the other ring attaches to a strap that extends along the bottom edge 120. At the top of each pole, D-rings 160 are held by fabric loops and provide attachments for the top ends of the cross-bracing straps. The fabric loops may be at the ends of a band 170 of fabric that chokingly encircles the cap 86 as shown. Or a band of fabric, with a ring at each end, could extend across and be supported by the top of a cap with the band in a generally inverted V-shape (not shown). Portions of the illustrated band 170 extend through buttonhole opening on opposite sides of the sleeve 128, with the D-rings located outside the sleeves. Other types of attachments for the cross-bracing straps could be provided at the tops and the bottoms of the poles.

Additional bracing may be provided for a pole 44 by a strap 180 that extends from the pole 44 to the frame. The straps 180 extend outwardly and downwardly from the poles 44, preferably from locations nearer the tops of the poles than the bottoms. A spring (not shown) is provided between the top and bottom attachment points of a strap 180 to provide elasticity. Most conveniently the spring is located at the top, between the top end of a guy strap 180 and the pole 44 to which that strap is attached.

The trampoline and enclosure are configured in such a way that an impact to the enclosure causes at least one entire pole to move downwardly. Due to the way in which the poles are coupled to the trampoline, the downwardly moved pole or poles force the rebounding mat 41 to move downwardly. And one or more of the spring members 39 may be moved downwardly as well. For example, in the embodiment of FIG. 1, a resilient mechanism 182 is provided by one or more spring members 39 and the mat 41 which are connected between at least one of the poles and the frame with the poles supported by the mat and connected to the spring members via the mat. The resilient mechanism stores energy upon an impact to the enclosure which causes at least one entire pole to move downwardly and releases energy to return the at least one entire pole upwardly once the impact force is removed.

The fence can serve as more than a passive safety restraint, but rather can form another rebounding surface. That is, the fence serves to store, and subsequently return, a substantial percentage of any impact energy, thereby propelling a jumper back onto the horizontal trampoline surface. Although there are no standardized metrics in the industry, one useful measurement is the percentage of energy returned to a substantially inelastic 100 pound object that horizontally impacts the fence netting at a location midway between the upright support poles, and midway up the height of the fence ("horizontal rebound factor"). Desirably, the horizontal rebound factor is at least 10%. By suitable selection of netting and support materials, and tensioning of the various members, significantly lower or higher horizontal rebound factors can be achieved, such as 1%, 5%, 20%, 30%, or 40%, or more.

The tops of the poles may be constructed to flex downwardly towards each other and towards the area of impact (just like loading a bow for shooting arrows, as noted earlier), it is possible for the fence system to conserve more of the impact force energy in the poles, enabling the system more efficiently to recycle this energy back into the impacting body. Top line 108 serves as a mechanism for transferring such loads between the poles. The freedom of motion afforded by line 108 enables the net to more completely conform to the surface of an impacting body, distributing the forces of impact over a larger surface area on the body, thereby reducing the likelihood of injury.)

As will be recognized by the artisan, numerous modifications and additions (and deletions) can readily be made to the above-detailed systems while maintaining the same general structures.

For example, there are alternative methods for securing the top line 108 to the poles 44. And the attachment of the wall to the poles can be different. Although not preferred, the wall fabric can be attached to the poles with cable ties or the like. In still other systems, the tubular vertical pocket 128 can be formed a distance away from the cylindrical wall, with the intervening space reinforced by vertical nylon webbing.

In still other systems, the net can be positioned outside the poles 44, rather than inside. For example, the strips of fabric that form the sleeves 128 can be sewn to the inwardly facing surface of the wall 100 instead of to the outwardly facing surface.

Still further, the net can be suspended inside one pole and outside the adjacent poles, or in other in/out configurations, depending on the particularly impact absorption requirements desired.

The protective caps 86 on the ends of the fence poles can have various forms. For example, a domed cap can be used, manufactured of a somewhat soft material to dampen impacts, while still providing protection from the top end of the support pole. The cap can be filled with foam or caulk for increased shock absorbency. The cap can also be provided with an accordion-type wall configuration, to enhance its shock absorbing ability. Combinations of the above-described end caps are similarly advantageous. While the illustrated cap is a sleeve that fits over a pole 44, the cap could just as easily be a plug that is received in the top opening of a tubular pole 44.

Variable Placement Net Fasteners

Due to the fact that there are a wide variety of sizes and configurations of trampolines on the market, a sound objective is to have a safety enclosure system that is compatible with most or all of them. Wide range compatibility is intrinsic to our (current) woven, open-mesh net system, but is not obvious when using a more finely woven fabric-like net. Typical with such a material, the fastening points (locations on the net where it can be connected to the structural members) are fixed in place at specific locations. (As a quick review, these fixed points on the net are determined by the locations of the vertical support poles. The pole locations are determined by the locations of the legs of the trampoline, which vary from one manufacturer to the next.) If employing the fixed-point configuration, the dimensions of various size trampolines need to be obtained, averaged, and the fasteners would be sewn at fixed points based on the calculations. All this would equate to extra costs associated with manufacturing, and possible confusion to the customer. Equally problematic, fabric-like nets for use in a fall prevention system are only as strong as the weakest "link." Because of their loosely woven nature, the weakest part of the net system occurs at the sewn fastening locations, and usually begins to separate at the extremities (i.e., the outmost stitched points).

Figure 6:
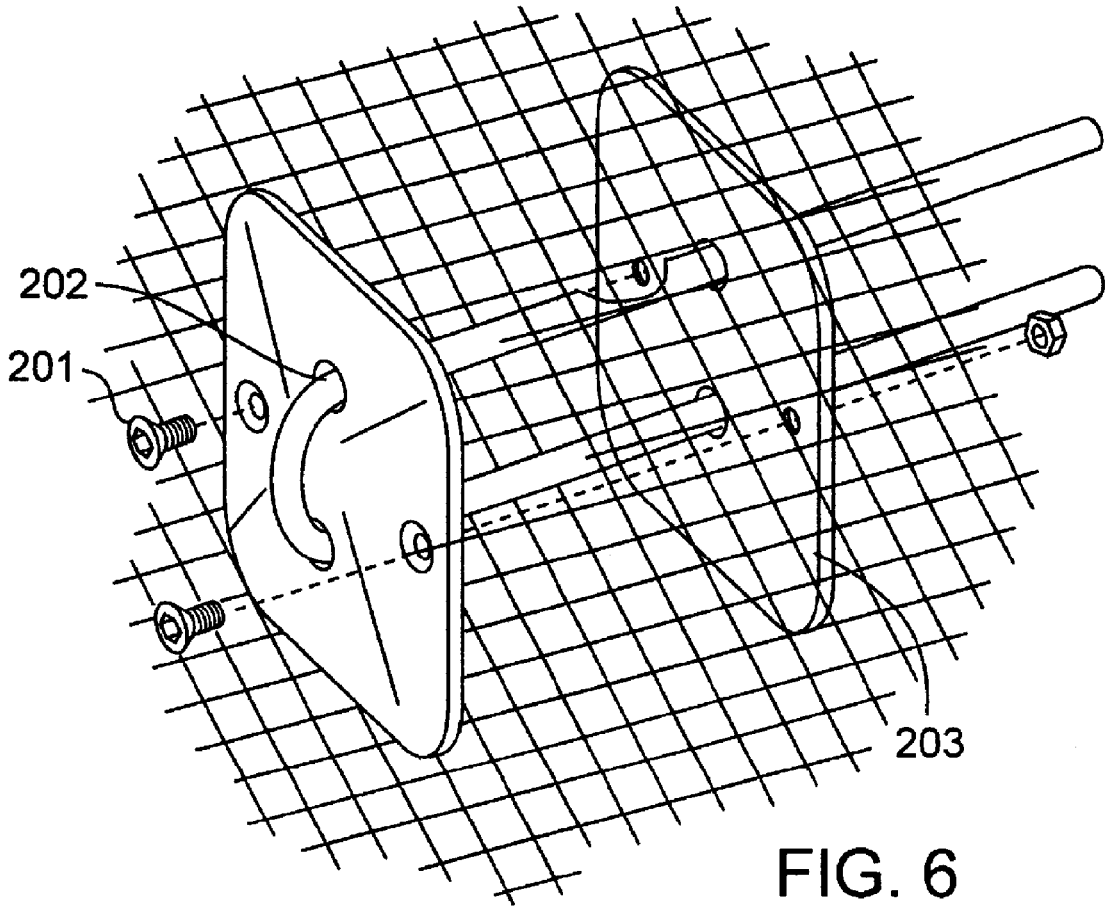
FIG. 6 is an exploded view of a variable placement net fastener.
Figure 7:
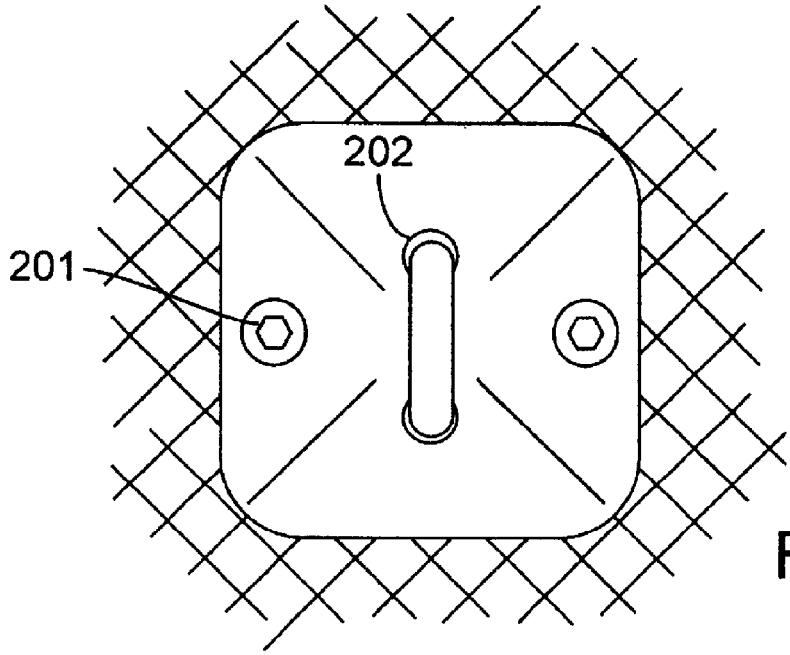
FIG. 7 is a front elevational view of the apparatus shown in FIG. 6.
Figure 9:
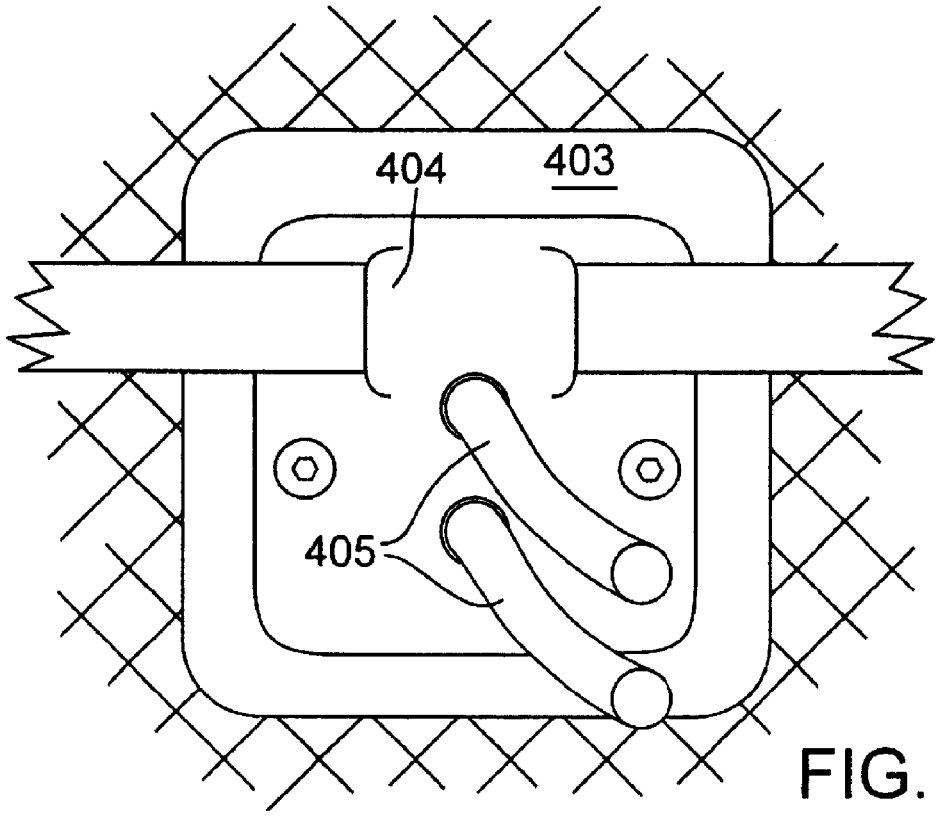
FIG. 9 is a rear elevational view of a variable placement net fastener securing a length of webbing.

In order to make a woven, fabric-like safety net readily compatible with trampolines of various sizes and shapes, and to address the fail-factor associated with sewing, we can employ the use of variable placement net fasteners. One such fastener, illustrated in FIGS. 6-7, would "sandwich" the net fabric between two rigid pieces of plastic (or other). The inner side of each fastener piece can have corresponding male/female connection points that would snap together through the net, be ribbed/grooved to generate friction (the grooves potentially matching the fabric pattern), be concave/convex, or utilize a frictional/cushion membrane as shown in FIG. 9. The pieces may be clamped together with one or more screws, so that any force exerted on the fastener would be distributed equally over the entire area of net "sandwiched" by the fastener. Two holes near the center of each fastener piece allow an elastic/inelastic cord/strap to be inserted and looped through the fastener, and then attached to a support pole. This configuration enables force to be distributed over the entire fastener assembly, instead of over only one piece of the fastener, and additionally distributes the force over a large surface area of the netting.

The walls of the fastener may be tapered, so that the edges are more pliable, allowing for some of the impact forces to be absorbed in the action of the fastener itself—or an inner friction/cushion membrane may extend out of the fastener with similar results.

Figure 8:
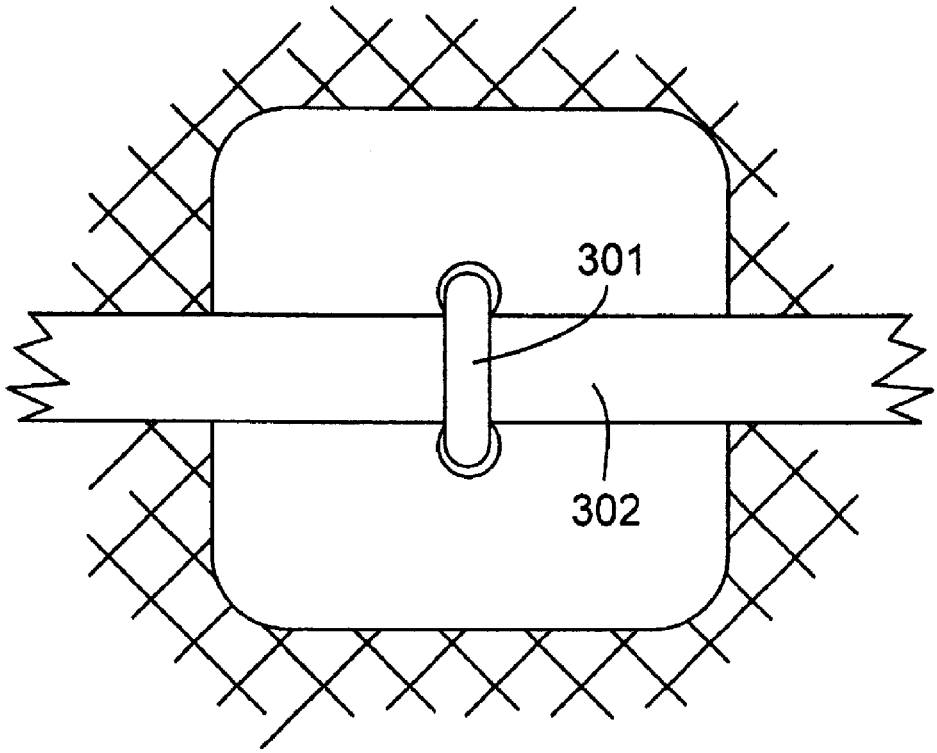
FIG. 8 is a front elevational view of the apparatus shown in FIG. 6, securing a length of webbing.

Webbing, incorporated with variable placement fasteners, can increase the amount of force a system can withstand. Webbing, running the circumference of the net, can either be fed through an eyelet on the fastener, or through the loop of elastic/inelastic cord formed at each fastener as illustrated in FIG. 8 and FIG. 9. When included, the webbing further helps to disburse forces to the other structural members of the system, thereby reducing forces placed directly on the net at each fastener.

Twisted Bungee Cords

When two ends of a bungee are fastened together, the resulting loop formed can be installed over a vertical pole (or end cap), twisted, and then attached to the net. Twisting the bungee is a unique feature when applied to a safety enclosure because it 1) creates a choke-hold to the pole, making the bungee less prone to slide down the pole, and 2) may distribute the forces of an impact more equally between the two strands (twists) of cord.

Multipurpose Protector Cap

Foam pads (covering support poles) not only protect users from coming into direct contact with support poles, they also help to absorb and distribute forces applied to the safety enclosure system. Likewise, the covers for the ends of the foam pieces not only protect the ends of the foam from deterioration, they can also aid in securing straps/cords that hold the net in place, allowing for the absorption property of the foam to be utilized.

Foam under protective caps also enables the foam to absorb some impact force when a protective cap is struck.

In view of the many embodiments in which the principles detailed above can be employed, it should be recognized that the disclosed systems are illustrative only and should not be taken as limiting the scope of the invention. For example, in some arrangements plugs may extend upwardly from the mat to be received in openings at the bottom ends of the poles to position the poles above the mat. Or upwardly opening cups or pockets could be provided in the mat or at the perimeter of the mat to receive the bottoms of the poles. The bottoms of the poles also could be attached to the mat by VELCRO® fasteners.

Figure 10:
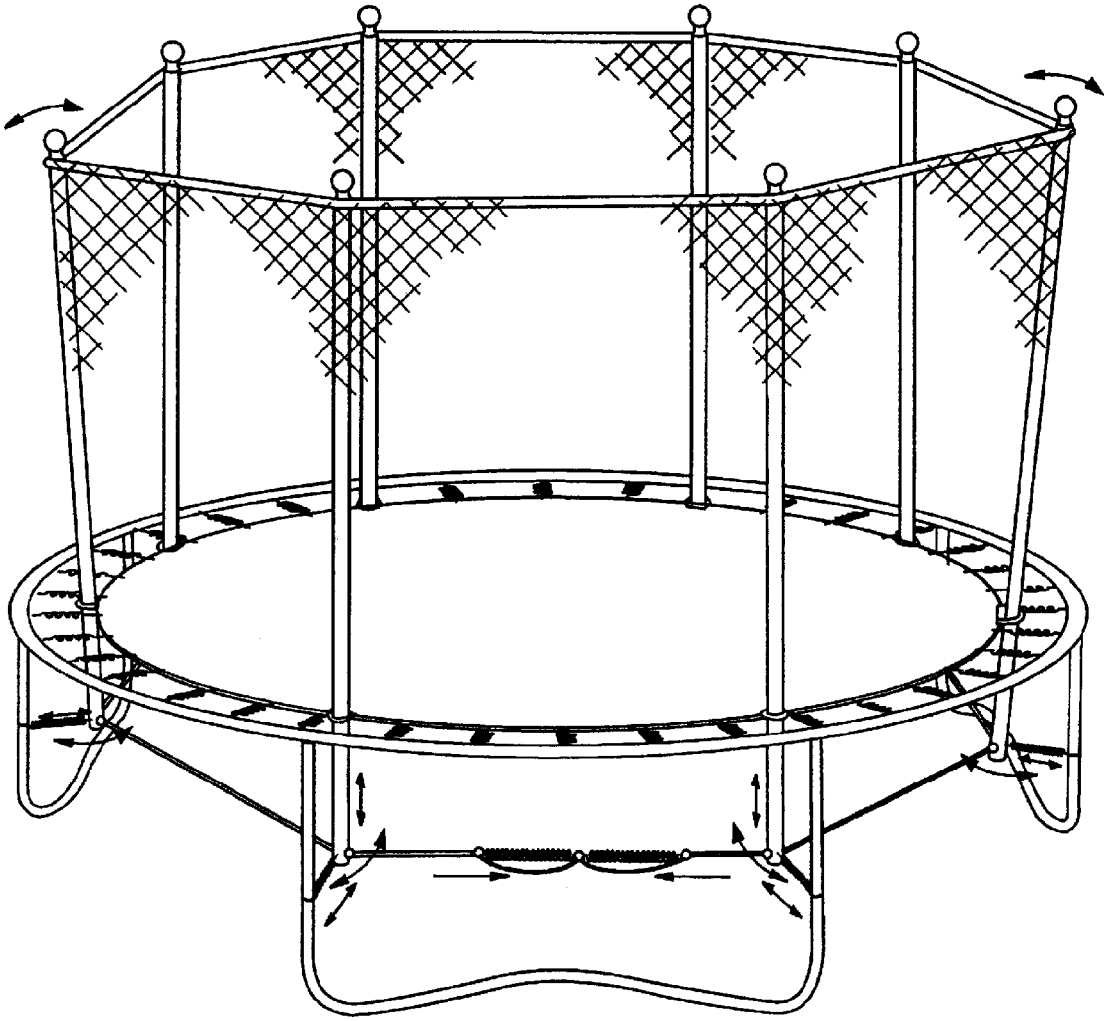
FIG. 10 is an oblique view showing a trampoline apparatus including an enclosure system.
Figure 11:
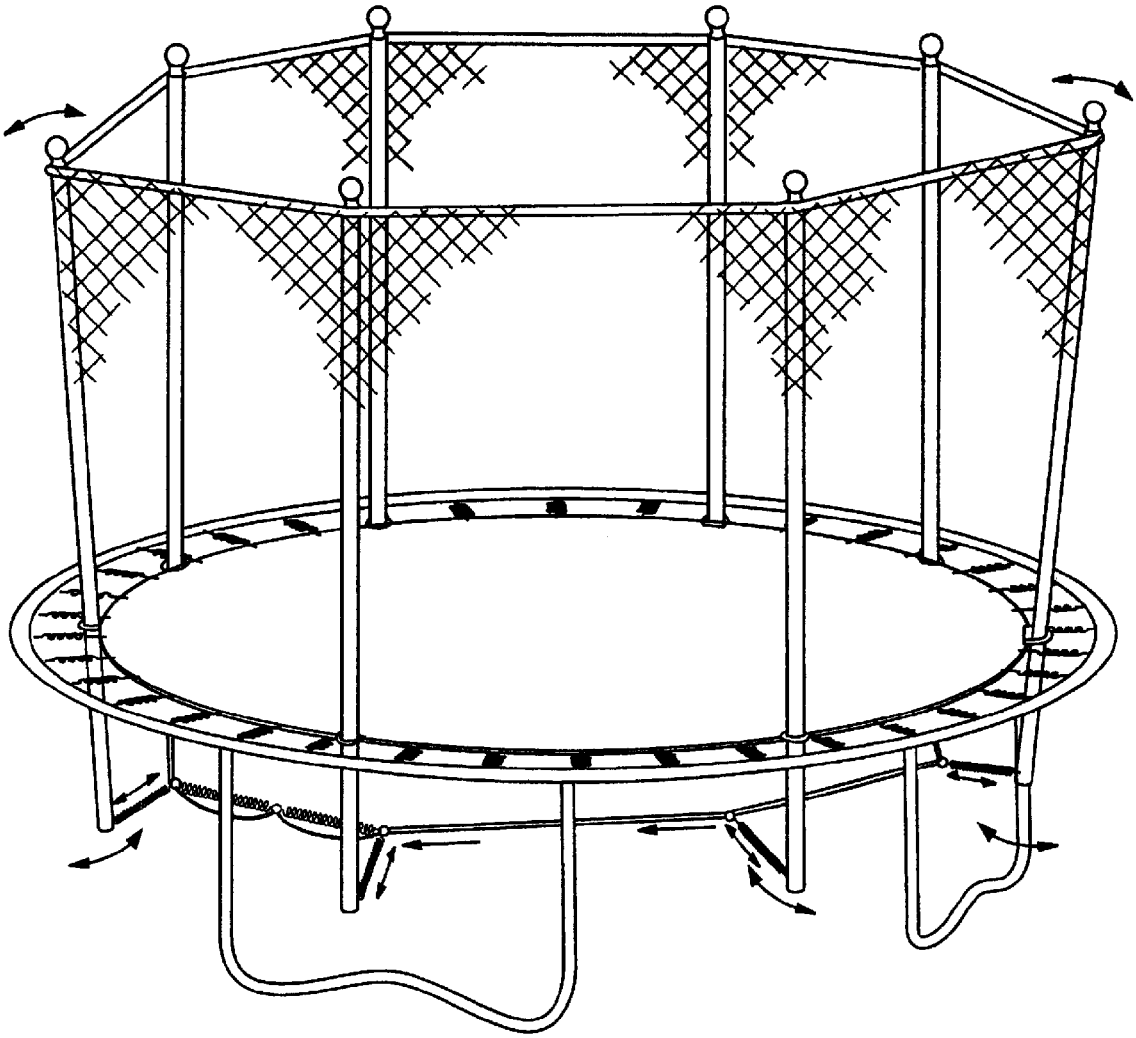
FIG. 11 is an oblique view showing a trampoline apparatus including an enclosure system.

In other arrangements, poles may extend partially below the level of the mat as shown in FIGS. 10-11, and may be connected to the springs such that downward motion of a pole causes one or more springs to move downwardly, which in turn may cause a portion of the mat to move downwardly. And in some arrangements, lengths of PVC pipe or the like can be substituted for the top line.

The invention claimed is:

1. A trampoline having a safety enclosure, comprising:

a trampoline comprising a frame and a rebounding mat coupled to the frame via plural spring members; and a safety enclosure comprising plural poles, with at least the lower halves of the poles extending upwardly at more than a 60 degree angle from horizontal, and a flexible material coupled to the poles, with the poles coupled to the rebounding mat to force the rebounding mat and one or more of the spring members downwardly upon an impact to the enclosure.

2. A trampoline having a safety enclosure, comprising:

a trampoline comprising a frame and a rebounding mat coupled to the frame via plural spring members; and a safety enclosure comprising plural poles, with at least the lower halves of the poles extending upwardly at more than a 60 degree angle from horizontal, and a flexible material coupled to the poles, with the poles coupled to at least one of the spring members to force the rebounding mat and one or more of the spring members downwardly upon an impact to the enclosure.

* * * * *